United States Patent [19]

Poertzgen et al.

[11] Patent Number: 5,012,996

[45] Date of Patent: May 7, 1991

[54] LENGTH VARIABLE AND LOCKABLE POSITIONING DEVICE

[75] Inventors: Gregor Poertzgen, Koblenz; Castor Fuhrmann, Brachtendorf; Hans-Josef Hosan, Neuwied, all of Fed. Rep. of Germany

[73] Assignee: Stabilus GmbH, Koblenz-Neuendorf, Fed. Rep. of Germany

[21] Appl. No.: 426,094

[22] Filed: Oct. 24, 1989

[30] Foreign Application Priority Data

Oct. 26, 1988 [DE] Fed. Rep. of Germany ..... 3836397

[51] Int. Cl.[5] ..... F16M 11/00

[52] U.S. Cl. ..... 248/161

[58] Field of Search ..... 248/161, 631, 562, 162.1, 248/404, 415; 297/345

[56] References Cited

U.S. PATENT DOCUMENTS 4,188,007 2/1980 Ubezio ..... 248/161 X
4,324,382 4/1982 Beukema et al. ..... 248/406.2
4,728,072 3/1988 Mitchell ..... 248/406.1

FOREIGN PATENT DOCUMENTS 1554478 11/1971 Fed. Rep. of Germany .
8321901 1/1985 Fed. Rep. of Germany .
8321901 1/1985 Fed. Rep. of Germany .
619604 10/1980 Liechtenstein .
2031057 4/1980 United Kingdom ..... 248/631
2159402 12/1985 United Kingdom .

*Primary Examiner*—Alvin C. Chin-Shue

[57] ABSTRACT

According to an illustrative example of the invention a gas spring has adjacent one end thereof an axially extending control pin. This control pin is prestressed towards an outer position and can be pushed inwards for opening a valve, which valve is provided in the passage between two working chambers established by a piston, said piston being fixed to a piston rod. When the pin is in its outward position, the gas spring is locked in the respective axial length. When the control pin is moved inwards, the axial length of the gas spring can be varied. The gas spring is intended for combination with a chair or table column. In combining the gas spring with a chair, the upper end of the gas spring cylinder is fixed to the lower side of the seat plate. The lower side of the seat plate is provided with a manipulating level. The manipulating lever engages the outer end of the control pin through a telescopic arrangement of control members or adapter elements. These control members can be adjusted with respect to each other in axial direction by axial movement without relative rotation during the axial movement. After the correct length of the telescopic arrangement has been adjusted, the telescopic members are fixed with respect to each other.

37 Claims, 5 Drawing Sheets

LENGTH VARIABLE AND LOCKABLE POSITIONING DEVICE

BACKGROUND OF THE INVENTION

When combining a gas spring with a seat plate of a chair, an operative connection is established between a manipulating lever provided at the seat plate and a control pin extending beyond the upper end of the gas spring through a locking adaptor unit. This locking adaptor unit has variable length, such as to be adapted to the distance between the engagement point of the manipulating lever and the upper end of the control pin. Such by length adjustment of the locking adapter unit, tolerances resulting from the manufacturing of the gas spring, the manufacturing of the seat plate and the assembling of the seat plate and the gas spring can be compensated for.

STATEMENT OF THE PRIOR ART

From German Patent 1 554 478 a hydropneumatic gas spring is known with a cylinder and a piston rod. A piston is fixed on the piston rod within the cylinder. The piston defines two working chambers within the cylinder. A valve is provided for selectively separating or connecting the working chambers. If the working chambers are separated, the piston rod is locked with respect to the cylinder. If the working chambers are connected, the piston rod is adjustable with respect to the cylinder. For controlling the valve, the piston rod is proved with a bore, and a control rod is guided within the bore. An outer end of the control rod extends beyond the outer end of the piston rod. This outer end of the control rod is used as a control pin for controlling the position of the valve.

From German Utility Model 83 21 901 a further type of gas spring is known. The piston rod extends through the lower end of the gas spring. A control pin extends through the upper end of the gas spring. The control pin controls a valve. This valve is located in a passage of the cylinder which passage connects the two working chambers on both sides of a piston fixed to the piston rod. The upper end of the cylinder is combined with a seat plate of a chair. The seat plate of the chair is provided with a manipulating lever. An axially movable adaptor unit is axially guided above the upper end of the cylinder. This unit engages with its lower end the upper end of the control pin and with its upper end an engagement point of the manipulating lever. The adapter unit consists of a tubular first adapter element engaging the control pin and a bolt-like upper adapter element which engages the manipulating lever. The tube-like lower element is prevented from rotation with respect to the cylinder. The bolt-like upper adapter element is provided with a key face and is screwed into the tube-like lower adapterelement. By screwing the bolt-like upper adapter element with respect to the tube-like lower adapter element, the axial length of the adapter unit can be precisely adjusted to the axial distance between the manipulating lever and the control pin. The length adjustment of the adapter unit is complicated and requires considerable skillfulness. Moreover, there exists the risk of misadjustment of the length of the adapter unit in operation.

OBJECT OF THE INVENTION

It is an object of the present invention to provide a positioning device in which the length adjustment of the adapter unit extending between the positioning device and a manipulating unit is facilitated.

A further object of the invention is to provide a positioning device in which the length adjustment is achieved substantially automatically when combining the positioning device with a respective construction, e.g. a chair or table construction.

SUMMARY OF THE INVENTION

A length variable and lockable positioning device has an axis and two ends. Adjacent one of its ends an axially oriented and axially movable locking adapter unit is provided for controlling locking means of said positioning device and for operative engagement with an external manipulating unit of a construction adapted to be operatively combined with said positioning device. This adapter unit has an adjustable axial length and comprises at least two telescopically interengaging adapter elements. A first adapter is operatively nearer to the positioning device and a second adapter element is operatively nearer to the manipulating unit. These adapter elements are axially adjustable with respect to each other without relative rotation during relative axial adjustment and are fixable with respect to each other in a plurality of relative axial adjustment positions with a fixing force sufficient to transmit axial adapter movement from said manipulating unit to said first adapter element.

With the positioning device of this invention, the axial adjustment can be automatically obtained by relative axial movement of the respective construction part and the positioning device when combining the positioning device with a construction, e.g. a chair or table construction of variable height.

The locking adapter unit may be prestressable towards a rest position by a prestress force and may be axially movable by the manipulating unit towards a control position against said prestress force. The adapter elements are relatively adjusted such before said positioning device is assembled with said construction that said axial length of said adapter unit is at a preadjustment value irrespective of the individual construction and the individual positioning device. The axial length is adjusted from said preadjustment value to an operational value by said positioning device being operatively combined with said construction. So, the length of the adapter unit is automatically adjusted to the individual construction and the individual positioning device, and manufacturing tolerances are compensated for.

The adapter elements may be secured in a relative position corresponding to the above said preadjustment value by a securing force. In order to make sure that in combining the positioning device and the construction, the axial length of the adapter unit is precisely adjusted without unlocking the positioning device, the securing force is selected smaller than the above-mentioned prestress force acting onto the adapter unit. Another possibility for reaching this aim is that said securing force is larger than said prestress force, and said releasable holding means are provided for axially holding said first adapter element in a rest position with respect to said positioning device during operatively combining said positioning device with said construction.

The securing force may be provided by a securing spring urging said adapter elements towards a relative preadjustment position corresponding to said preadjustment value of length.

It is also possible that said securing force is provided by a relative frictional engagement of said adapter elements.

Further, it is possible that said securing force is provided by a spacer body destroyable response to axial relative adjustment of said adapter elements towards said operational value of length.

The fixing force necessary for maintaining the axial length of the adapter unit during operation may be established by relative rotation of said adapter elements about an axis of relative rotation, said relative rotation being substantially free of axial relative movement of said adapter elements.

A positive relative fixation of the adapter element by relative rotation is possible, if one of said adapter elements is provided with at least one circumferentially extending fixing edge, said fixing edge being engageable into an adjacent circumferential fixing face of the respective other adapter element by relative rotation of said adapter elements about said axis of relative rotation. In such an embodiment at least one of said fixing edge and said fixing face may have a substantially spiral configuration about said axis of relative rotation of said adapter elements such that said fixing edge progressively enters or cuts into said fixing face in response to relative rotation of said adapter elements. For reasons of facilitating manufacturing of the respective elements, the fixing edge may be a radially outwards directed fixing edge engaging into a radially inwards directed fixing face. A very reliable construction of the adapter unit is obtained in that one of said adapter elements is provided with at least one pair of diametrically opposed fixing edges and the other of said adapter elements is provided with a corresponding pair of diametrically opposed fixing faces.

For facilitating the fixation of the adapter elements by relative rotation, the relative rotation of said adapter elements about said axis of relative rotation may be limited by respective rotation abutment faces of said adapter elements.

The adapter elements may be protected against relative reverse rotation after said fixing force has been established by relative rotation.

For facilitating the relative rotation of the adapter elements, said first adapter element may be prohibited from relative rotation with respect to said positioning device about said axis of relative rotation, such that a rotational torque must be applied only to the second adapter element.

At least one of said adapter elements may be provided with at least one key face for being engageable by a turning tool.

A further possibility of fixing the adjusted operational length of the adapter unit provides that said fixing force is obtained by activation of an adhesive in response to axial relative adjustment of said adapter elements, towards an operational relative position. This adhesive may be contained within a destroyable capsule, said destroyable capsule being destroyed in response to an adjustment of said adapter elements towards said operational relative position. An extremely rapidly hardening adhesive may be used.

The fixing force may also be provided by relative frictional engagement of said adapter elements. In this case, the fixing force must be larger than a prestress force stressing said first locking element towards a rest position, with respect to the positioning device, and releasable holding means may be provided for axially holding said first adapter element in said rest position with respect to said positioning device during operatively combining said positioning device with said construction.

The first adapter element may be provided with a substantially axially directed bore, and said second adapter element may be provided with a shaft member received by said bore.

According to a preferred embodiment, said positioning device comprises a gas spring. Such a gas spring may be provided with an axially extending pin adjacent said one end of said positioning device, and said first adapter element may axially engage an end of said adapter pin.

The adapter unit may axially be guided within a guiding sleeve, and this guiding sleeve may be accommodated within a tubular extension of the positioning device. In case of a gas spring, the tubular extension may be an integral part of a cylinder of said gas spring or an integral part of an encapsulating tube encapsulating a cylinder of said gas spring.

For further facilitating the combination of the positioning device and the respective construction, the manipulating unit may have a substantially axially movable engagement member acting onto the adapter unit, and this engagement member may have an axial stroke limited by first stroke abutment means, said first stroke abutment means maintaining said engagement member in a first axial position, when assembling said construction unit and said positioning device, such as to provide axial relative adjustment of said control elements. In such a construction with first stroke abutment means, the manipulating lever is free of wobbling after said combination.

Moreover, the axial stroke may be limited by second stroke abutment means, said second stroke abutment means preventing excessive axial movement of said engagement member beyond a second axial position and thus preventing axially relative shifting of said adapter elements in operation.

The various features of the invention are discussed especially in the accompanying claims which form a part of the disclosure. For the better understanding of the invention, its working advantages and specific effects, reference is now made to the accompanying drawings and the description, in which preferred forms of embodiment of the invention are discussed.

BRIEF DESCRIPTION OF THE DRAWINGS

The invention is represented in the accompanying drawings and will be described in greater detail below. In the drawings.

DETAILED DESCRIPTION OF THE PREFFERED EMBODIMENTS

Figure 5:
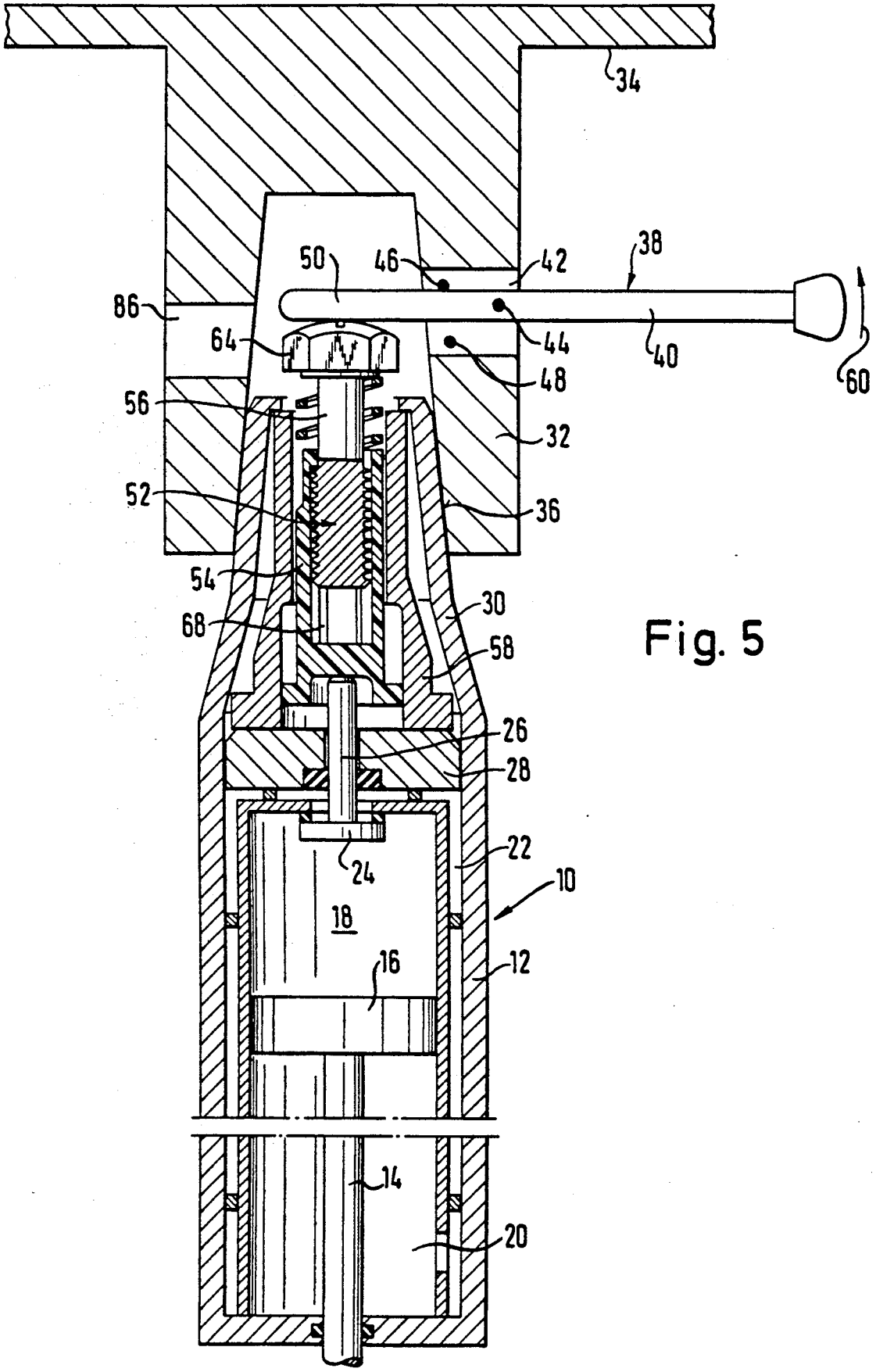
FIG. 5 shows a gas spring in combination with a seat plate of a chair and comprising a length variable adapter unit as shown in FIG. 1.

In FIG. 5 a gas spring is designated by 10. The gas spring comprises a cylinder 12 and a piston rod 14. The piston rod 14 is provided with a piston 16. The piston 16 defines two working chambers 18 and 20 within the cylinder 12. A passage 22 interconnects the working chambers 18 and 20. A valve plate 24 is provided within the passage 22 for opening and closing the connection between the working chambers 18 and 20. The valve plate 24 is provided with a adapter pin 26 passing through a head plate 28 of the gas spring. The working chambers 18 and 20 are filled with gas under pressure. When the valve plate is in its closed position as shown, the piston 16 and the piston rod 14 are axially fixed with respect to the cylinder 12. The cylinder 12 is guided in a stand tube (not shown) which is supported by chair legs. The lower end of the piston rod 14 is fixed to a bottom plate of the stand tube, such as to be axially fixed and rotatable with respect to the bottom plate (not shown).

The gas pressure within the working chamber 18 acts onto the valve plate 24 and the adapter pin such that the adapter pin 26 is prestressed in upward direction. For axial height adjustment of the chair column, the control pin 26 is pushed downwards against the prestress force acting thereon such that the passage 20 is opened, gas can flow between the working chambers 18 and 20, and the piston rod 14 can be axially moved with respect to the cylinder 12.

The cylinder 12 is provided with a tapered axial extension 30. A socket 32 of a seat plate 34 is connected with the tubular extension 30 by conical engagement at 36. The socket 32 is provided with a manipulating unit 38 comprising a manipulating lever 40 extending through a radial window 42 of the socket 32. The manipulating lever 40 is rockable about a bearing pin 44 and is limited in rocking movement by first and second abutment pins 46, 48, respectively.

The inner end portion 50 of the manipulating lever 40 acts onto the adapter unit 52 consisting of a tube-like adapter element, 54 and a bolt-like adapter element 56. The adapter unit 52 is in operation such adjusted in axial length that the adapter element 54 is in contact engagement with the adapter pin 26, when the valve plate 24 is in its uppermost closed position and that simultaneously the upper end of the adapter element 56 is in engagement with the part 50 of the manipulating lever 40, when the manipulating lever 40 abuts the abutment pin 46. The adapter element 54 is axially movably but not rotatably guided within a guiding sleeve 58. This guiding sleeve 58 is fixed within the tubular extension 30 both against axial and rotational movement. By rocking the manipulating lever in the direction of arrow 60, the adapter pin is moved downwards against the prestress force exerted by the gas pressure onto the valve plate 24 such that the passage 22 is opened. The adapter unit is shown in a greater scale in FIGS. 1 and 2.

Figure 2:
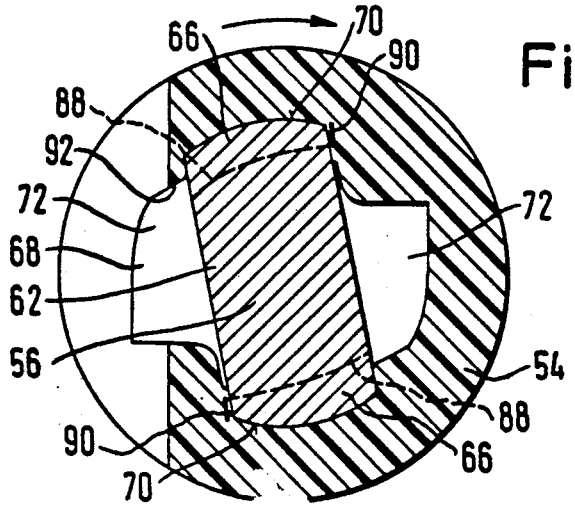
FIG. 2 shows a section according to line II—II of FIG. 1.

The adapter element 56 is provided with a shaft 62 and a hexagonal head 64. The shaft 62 is flattened in its lower portion as shown in FIG. 2. The shaft is provided with two diametrically opposed groups of circumferentially extending cutting edges 66 within a bore 68 of the tube-like adapter element 54. The cutting edges 66 are in cutting engagement with engagement faces 70 of the bore 68. The bore 68 is provided with free space 72 for receiving the cutting edges 66 without engagement into the material of the adapter element 54. The adapter element 54 is made of hard-elastic material, preferably plastic material.

The uppermost cutting edge 66 engages an inwardly directed projection 76 of the adapter element 54, when the adapter element 56 takes its uppermost position within the bore 68. A helical compression spring 78 is supported by an upper end face 80 of the adapter element 54 and acts onto a lower end face 82 of the head 64, so as to secure the adapter element 56 in its uppermost position, when the cutting edges 66 are accommodated within the free spaces 72. In the uppermost position of the adapter element 56 with respect to the adapter element 54, the total length L of the adapter unit 52 is larger than the distance between the adapter pin 26 and the part 50 of the manipulating lever 40, as shown in FIG. 5, and this is true for all combinations of seat plates 34 and allocated gas springs independently of manufacturing and assembling tolerances to be expected.

The gas spring manufacturer supplies the gas springs to the chair manufacturer with the cutting edges being accommodated within the free spaces 72 and with the adapter element 56 having its uppermost position with respect to the adapter element 54 due to the securing action of the helical compression spring 78. When the gas spring 10 is combined with the seat plate 34 as shown in FIG. 5, the head 64 of the adapter element 56 engages the part 50 of the manipulating lever 40, which manipulating lever 40 is engaging the abutment pin 46. As the spring force of the helical compression spring 78 is smaller than the prestress force acting onto the adapter pin 26, the control pin 26 remains in its uppermost or closed position as seen in FIG. 5, when the socket 32 is pressed onto the tapered tubular extension 30. The adapter element 56 is, however, pushed downwards within the bore 68 against the action of the helical compression spring 78. So, the length adjustable adapter unit 52 is adjusted to its operational length, which makes sure that the valve plate 24 is still closed and the manipulating lever 40 is in abutment with the abutment pin 46 and that wobbling of the manipulating lever about the bearing pin 40 is eliminated. Now, the adapter element 56 is rotated with respect to the adapter element 54 such that the cutting edges 66 cut into the engagement faces 70, as seen in FIG. 2. This relative rotation can be easily accomplished because the adapter element 54 is non-rotatable with respect to the guiding sleeve 58, and the guiding sleeve 58 is non-rotatable with respect to the tubular extension 30. So, it is only necessary to exert a torque onto the head 64 of the adapter element 56 by a turning tool to be approached to the head 64 by a window 86 provided in the socket 32 of FIG. 1.

It is to be noted from FIG. 2 that the cutting edges 66 have a spiral configuration with respect to circumferential lines 88, as shown in FIG. 2 so that the cutting edges 66 progressively cut into the engagement faces 70, when the cutting edges 66 are rotated from the free spaces 72 into engagement with the engagement faces 70. The relative rotation of the adapter elements 56 and 54 is limited by abutment face 90. When the flattened faces of the shaft 62 engage the abutment faces 90, a lip portion 92 of the elastic material of the adapter element 54 springs radially inwards and prevents reverse rotation of the adapter element 56 with respect to the adapter element 54.

Figure 1:
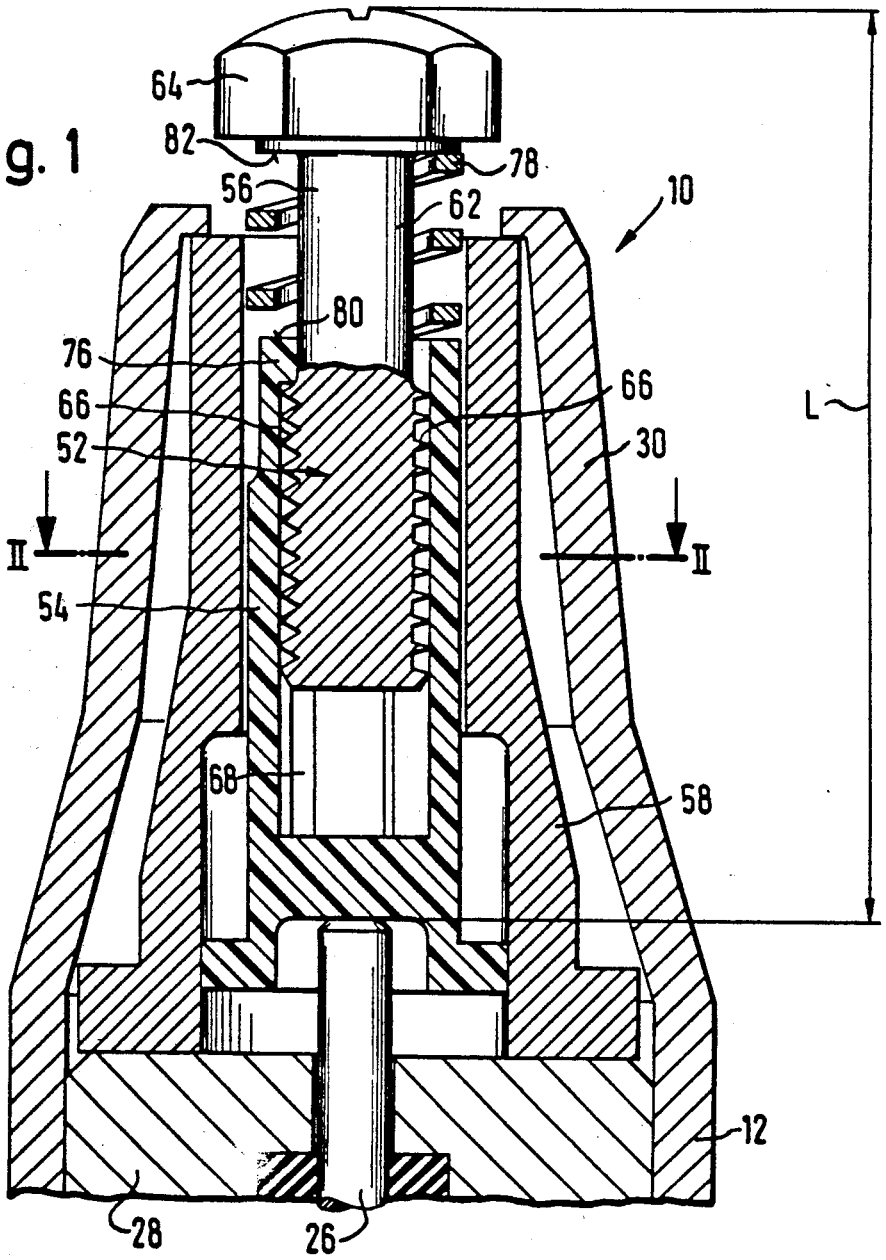
FIG. 1 shows a first embodiment of a length adjustable adapter unit.

It is to be noted that the engagement between adapter elements 54 and 56 in FIG. 1 could be also used between a adapter element directly telescoped onto the adapter pin 26 in which case it would be desirable, however, to prevent the adapter pin 26 from rotation.

Figure 6:
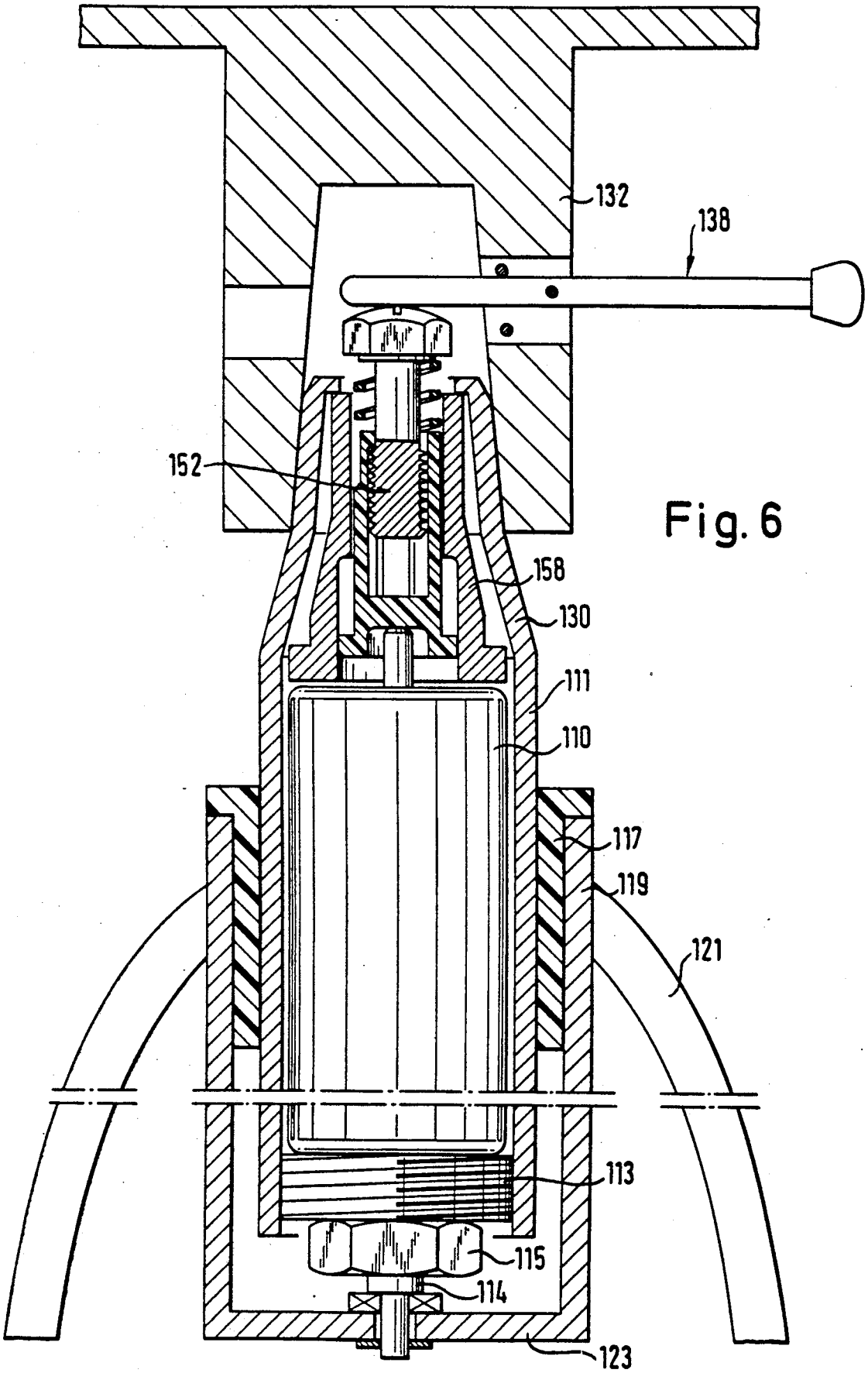
FIG. 6 shows a complete chair column in which the cylinder of the gas spring is encapsulated by a protection tube, a adapter unit according to FIG. 1 being combined with the gas spring within the protection tube.

In FIG. 6, a complete chair column is shown. In this case, a gas spring 110 is housed within a protection tube 111. The guiding tube 158 is here accommodated within a tubular extension 130 of the protection tube 111. The gas spring 110 is axially fixed within the protection tube 111 by a screw ring 113 with a hexagonal key face 115. The protection tube 111 is axially guided by a guiding insert 117 within a stand tube 119. The stand tube 119 is provided with legs 121. The lower end of the piston rod 114 is axially fixed but rotatably mounted on a bottom plate 123 of the stand tube 119. The adapter unit 152, the socket 132 and the manipulating unit 138 are identical with the embodiment of FIGS. 1, 2 and 5.

Figure 3:
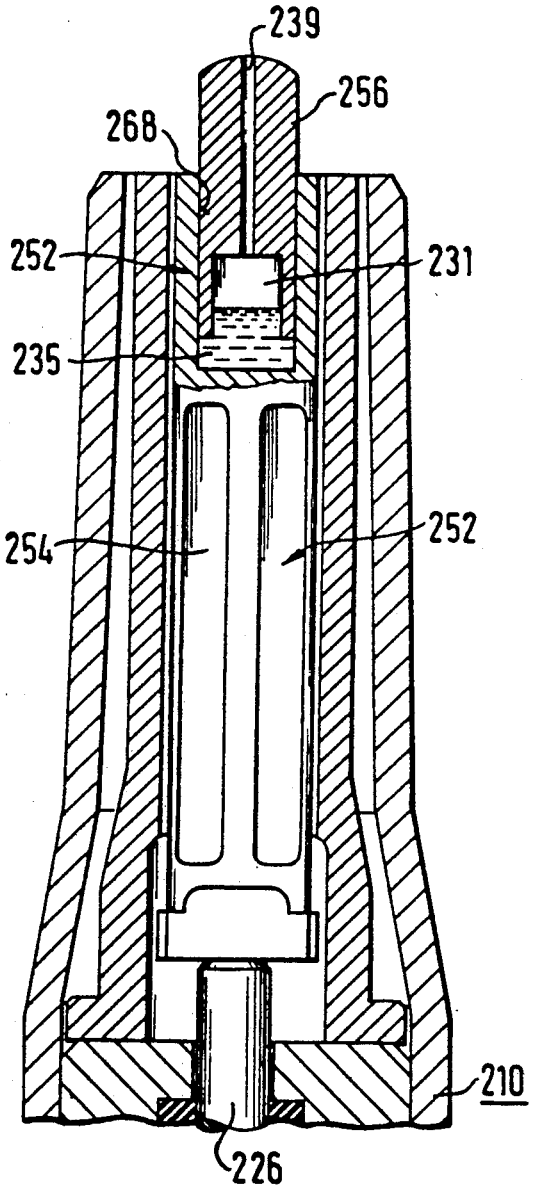
FIG. 3 shows a second embodiment of a length adjustable adapter unit in operation.
Figure 3A:
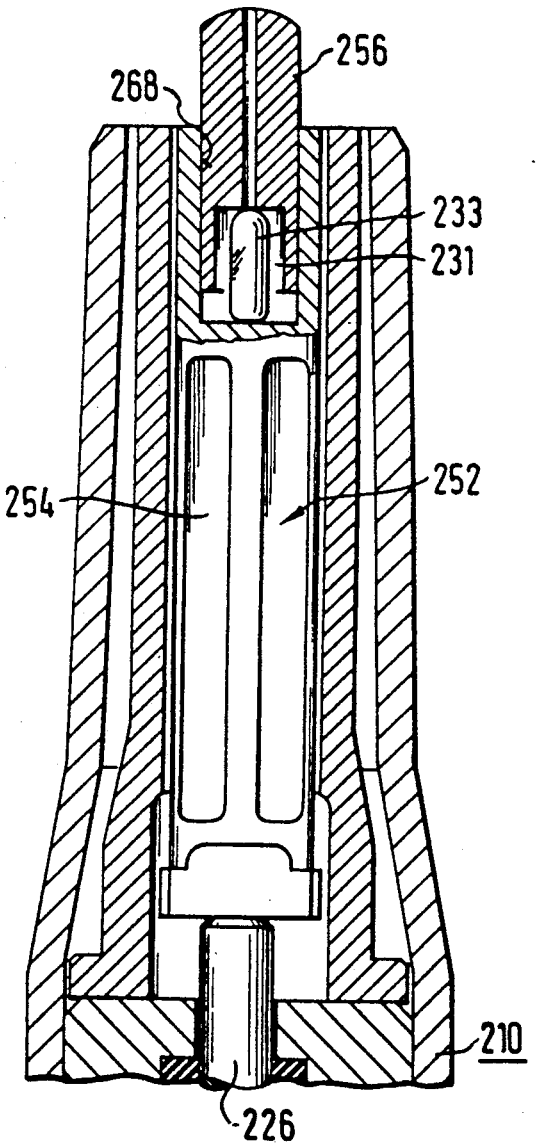
FIG. 3*a* shows the embodiment of FIG. 3 before combination with a respective construction.

The embodiment as shown in FIGS. 3 and 3*a* is to be used in combination with a chair construction or table construction as shown in FIGS. 5 and 6. Only the adapter unit 252 has been modified over the embodiments of FIGS. 1, 2, 5 and 6. The adapter unit 252 comprises a first control element 254 and a second adapter element 256. The first adapter element 254 acts onto the adapter pin 226. The second adapter element 256 is frictionally guided in a bore 268 of the first adapter element 254. In a cavity 231 within the first adapter element 254, there is provided-as shown in FIG. 3*a*—before combining the gas spring with a chair construction, a destroyable capsule 233 containing a liquid rapidly hardening adhesive. The adapter element 256 is in frictional engagement with the bore 268 with a securing face which is smaller than the prestress force acting onto the adapter pin 226. The capsule 233 is destroyable with a small destruction force so that the sum of the frictional securing force and the destruction force is still smaller than the prestress force acting onto the adapter pin 226. When the gas spring is combined with a socket, as shown in FIG. 5, the control pin maintains its position as shown in FIG. 3*a* so that the valve 24 as shown in FIG. 5 remains closed. The adapter element 256 is axially shifted into its operation position as described in connection with FIG. 5. During this axial movement, the capsule 233 is broken and the adhesive 235 flows into the cavity 231 as shown in FIG. 3. After air contact the adhesive 235 rapidly hardens so that the adapter element 256 is fixed with respect to the adapter element 254 with a fixing force sufficient to overcome the prestress force acting onto the adapter pin 226. So, the valve plate 24 can be pushed into open condition by rocking the manipulating lever 40. The air access to the adhesive is possible through an axial bore 239 within the control element 256. This axial bore 239 can also allow escape of excessive adhesive, if necessary.

In the embodiment of FIGS. 3 and 3*a*, no additional manipulation is necessary after combining the gas spring 210 with a socket 32, as shown in FIG. 5. It is only necessary to delay the first activation of the lever 40 until the adhesive 235 has been hardened, such as to provide a fixing force larger than the prestress force acting on the adapter pin 226. It is to be noted that the securing force resulting from frictional engagement of the adapter elements 254 and 256 is desirable in order to maintain the axial length of the adapter unit 252 before combination with the chair construction at a value exceeding the range of operational values to be expectable. It is needless to say that the frictional securing as shown in FIGS. 3 and 3*a* may be replaced by an elastic securing as shown in FIG. 1 (spring 78) and vice versa.

FIG. 4, one finds again the upper portion of a gas spring with a further modified embodiment of a adapter unit 352. The adapter unit 352 comprises a first control element 354 with a bore 368 and a second adapter element 356 in frictional engagement with said bore 368. The securing force resulting from frictional engagement of the adapter element 356 with the bore 368 of the adapter element 354 is larger than the prestress force acting onto the adapter pin 326. A releasable holding ring 351 is provided on the adapter element 354 and engages an upper end face 353 of the guiding sleeve 358. When the gas spring 310 is combined with a chair unit as shown in FIG. 5 the adapter element 356 is adjusted from its extended preadjustment position to the required operational position because the holding ring 351 prevents downward movement of the adapter element 354 towards the adapter pin 326 so that the adapter pin 326 remains in its position corresponding to closure of the valve plate. After the gas spring 310 nas been combined with the socket of e.g. FIG. 5, the required length of the adapter unit 352 has been established, and now the holding ring 351 can be removed. Now the adapter pin 326 can be moved downwards towards a valve opening position by rocking the manipulating lever 40 of FIG. 5 because the fixing force resulting from frictional engagement of the adapter element 356 into the bore 368 is larger than the prestress force acting onto the adapter pin 326.

It is easily to be understandable that the holding ring 351 could be replaced by a holding tool applied only during the combination of the gas spring 310 with the socket 32 as shown in FIG. 5.

Figure 4:
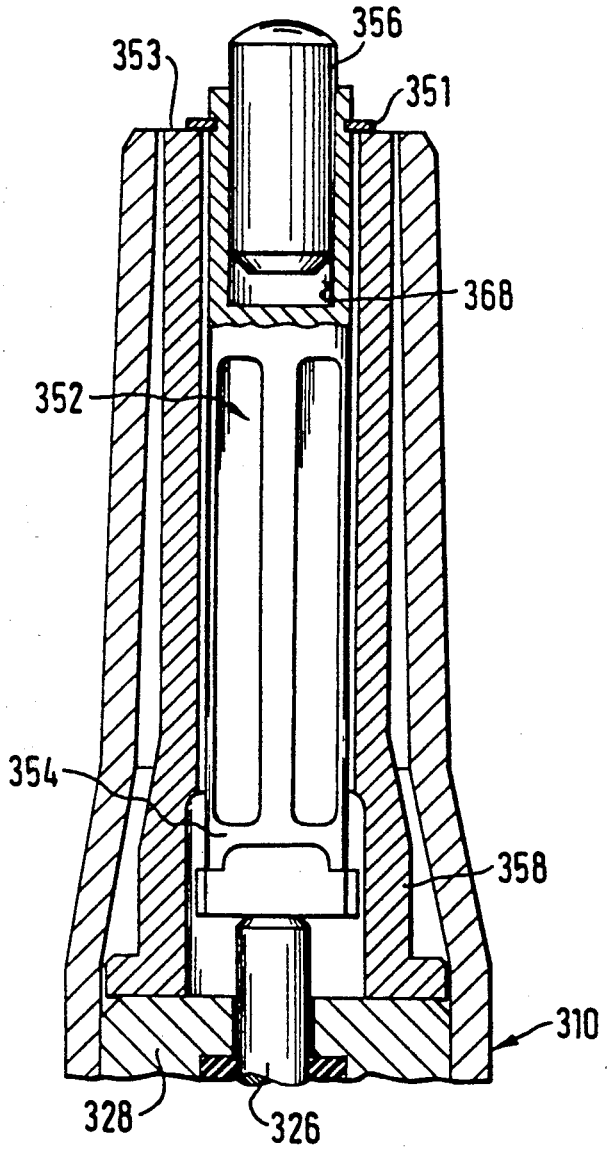
FIG. 4 shows a third embodiment of a length adjustable adapter unit.

In the embodiment of FIG. 4, the adjustment could be made also as follows: It is assumed that no holding ring 351 is provided and that the adapter element 356 takes its uppermost position with respect to the adapter element 354. The frictional force between the adapter elements 356 and 354 is again larger than the prestress force acting onto the adapter pin 326. The socket 32 (FIG. 5) is pressed onto the tubular extension 30. As the frictional force between the adapter elements 56 and 54 is larger than the prestress force acting onto the adapter pin 26, the adapter unit 52 is urged downwards as a rigid unit until the adapter element 354 abuts the plate 328, the manipulating lever 340 being in engagement with the abutment pin 46 (FIG. 5). If on abutment of the adapter element 354 on the plate 328 the socket 32 has not yet reached its final position on the extension 30, further approach of the socket 32 and the extension 30 is allowed by downward movement of the adapter element 356 with respect to the adapter element 354 against the frictional force. After the socket 32 has reached its final position on the extension 30, the manipulating lever 40 is rocked according to arrow 60 of FIG. 5, until it abuts the abutment pin 48. During this, rocking of the manipulating lever 40, the adapter element 356 is still further moved downwards and arrives in its correctly adjusted position, when the manipulating lever 40 abuts the abutment pin 48.

Specific forms of embodiment of the invention have been represented and described in order to illustrate the use of the principles of the invention. Of course, the invention can also be realized in other ways without departing from these principles.

The reference numbers in the claims serve only for facilitation of understanding and are not to be understood as a limitation.

We claim:

1. A length variable and lockable positioning device having a longitudinal axis and two ends and having adjacent one of its ends a locking control system with an adapter unit (52), said adapter unit (52) being oriented and movable along said longitudinal axis and having one end in operative connection with a locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56), a first adapter element (54) operatively nearer to said locking means (24) and a second adapter element (56) operatively nearer to said manipulating unit (38), said adapter elements (54,56) being axially adjustable with respect to each other without relative rotation during relative axial adjustment and being fixable with respect to each other in a plurality of relative axial adjustment positions L with a fixing force sufficient to transmit axial control movement from said manipulating unit (38) to said first adapter element (54).

2. A positioning device as set forth in claim 1, said adapter unit (52) being prestressable towards a rest position with respect to said positioning device by a prestress force and being axially movable by said manipulating unit (38) towards a control position against said prestress force, said adapter elements (54,56) being adjusted before said positioning device (10) is assembled with said construction (32) in a relative position in which said axial length of said adapter unit (52) is at a preadjustment value, said axial length being adjusted from said preadjustment value to an operational value by said positioning device (10) being operatively combined with said construction (32).

3. A positioning device as set forth in claim 2, said adapter elements (54,56) being secured in a relative position corresponding to said preadjustment value by a securing force.

4. A positioning device as set forth in claim 3, said securing force being smaller than said prestress force.

5. A positioning device as set forth in claim 3, said securing force being larger than said prestress force, releasable holding means (351) being provided for axially holding said first adapter element (354) in a rest position with respect to said positioning device (310) during operatively combining said positioning device (310) with said construction (32).

6. A positioning device as set forth in claim 3, said securing force being provided by a securing spring (78) urging said adapter elements (54,56) towards a relative preadjustment position corresponding to said preadjustment value.

7. A positioning device as set forth in claim 3, said securing force being provided by relative frictional engagement of said adapter elements (254,256).

8. A positioning device as set forth in claim 3, said securing force being provided by a spacer body (233) destroyable in response to axial relative adjustment of said adapter elements (254,256) towards said operational value of length.

9. A positioning device as set forth in claim 1, said fixing force being established by relative rotation of said adapter elements (54,56) about an axis of relative rotation in a first sense of relative rotation, said relative rotation movement being substantially free of axial relative movement of said adapter elements (54,56) with said relative rotation being less than 360°.

10. A positioning device as set forth in claim 9, one of said adapter elements (54,56) being provided with at least one circumferentially extending fixing edge (66), said fixing edge (66) being engageable into an adjacent circumferential fixing face (70) of the respective other adapter element (54) by relative rotation of said adapter elements (54,56) about said axis of relative rotation.

11. A positioning device as set forth in claim 10, at least one of said fixing edge (66) and said fixing face (70) having a substantially spiral configuration about said axis of relative rotation of said adapter elements (54,56) such that said fixing edge (66) progressively enters or cuts into said fixing face (70) in response to relative rotation of said adapter elements (54,56).

12. A positioning device as set forth in claim 10, said fixing edge (66) being a radially outwards directed fixing edge (66) engaging into a radially inwards directed fixing face (70).

13. A positioning device as set forth in claim 10, one of said adapter elements (54,56) being provided with at least one pair of diametrically opposed fixing edges (66) and the other of said adapter elements (54,56) being provided with a corresponding pair of diametrically opposed fixing faces (70).

14. A positioning device as set forth in claim 9, said relative rotation of said adapter elements (54,56) about said axis of relative rotation being limited by respective rotation abutment faces (90) of said adapter elements (54,56).

15. A positioning device as set forth in claim 9, said adapter elements (54,56) being protected against relative rotation in a second sense of relative rotation after said fixing force has been established by relative rotation in a first sense of relative rotation.

16. A positioning device as set forth in claim 9, said first adapter element (54) being prohibited from relative rotation with respect to said positioning device (10) about said axis of relative rotation.

17. A positioning device as set forth in claim 9, at least one of said adapter elements (54,56) being provided with at least one key face (64) for being engageable by a turning tool.

18. A positioning device as set forth in claim 1, said fixing force being obtained by activation of an adhesive (235) in response to axial relative adjustment of said adapter elements (254,256) towards an operational relative position.

19. A positioning device as set forth in claim 18, said adhesive (235) being contained within a destroyable capsule (233), said destroyable capsule (233) being destroyed in response to an adjustment of said adapter elements (254,256) towards said operational relative position.

20. A positioning device as set forth in claim 1, said fixing force being provided by relative frictional engagement of said adapter elements (354,356), said fixing force being larger than a prestress force prestressing said first adapter element (354) towards a rest position, with respect to said positioning device (310), releasable holding means (351) being provided for axially holding said first adapter element (354) in said rest position with respect to said positioning device (310) during operatively combining said positioning device (310) with said construction (32).

21. A positioning device as set forth in claim 1, said first adapter element (54) being provided with a substantially axially directed bore (68) and said second adapter element (56) being provided with a shaft member (62) received by said bore (68).

22. A positioning device as set forth in claim 1, said positioning device comprising a (10).

23. A positioning device as set forth in claim 22, said gas spring (10) being provided with an axially extending control pin (26) adjacent said one end of said positioning device, said first adapter element (54) axially engaging an end of said adapter pin (26).

24. A positioning device as set forth in claim 23, said adapter unit (52) being axially guided within a guiding sleeve (58), said guiding sleeve (58) being accommodated within a tubular extension (30) of said positioning device.

25. A positioning device as set forth in claim 24, said tubular extension (30) being an integral part of a cylinder (12) of said gas spring (10).

26. A positioning device as set forth in claim 24, said tubular extension (130) being an integral part of an encapsulating tube (111) encapsulating a cylinder of said gas spring (110).

27. A positioning device as set forth in claim 1 said manipulating unit (38) having a substantially axially movable engagement member (50) acting onto said adapter unit (52), said engagement member (50) having an axial stroke limited by first stroke abutment means (46), said first stroke abutment means (46) maintaining said engagement member (50) in a first axial position, when assembling said construction unit (32) and said positioning device (10), such as to provide axial relative adjustment of said adapter elements (54,56).

28. A positioning device, as set forth in claim 27, said axial stroke (48) being limited by second stroke abutment means (48), said second stroke abutment means (48) preventing excessive axial movement of said engagement member (50) beyond a second axial position and thus preventing axially relative shifting of said adapter elements (54,56) in operation.

29. A length variable and lockable positioning device having a longitudinal axis and two ends and having adjacent one of its ends a locking control system with an adapter unit (52), said adapter unit (52) being oriented and movable along said longitudinal axis and having one end in operative connection with a locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56), a first adapter element (54) operatively nearer to said locking means (24) and a second adapter element (56) operatively nearer to said manipulating unit (38), said adapter elements (54,56) being axially adjustable with respect to each other without relative rotation during relative axial adjustment and being fixable with respect to each other in a plurality of relative axial adjustment positioning L with a fixing force sufficient to transmit axial control movement from said manipulating unit (38) to said first adapter element (54), said locking adapter unit (52) being prestressable towards a rest position by a prestress force and being axially movable by said manipulating unit (38) towards a control position against said prestress force, said adapter elements (54,56) being relatively adjusted, before said positioning device (10) is assembled with said construction (32), such that said axial length of said adapter unit (52) is at a preadjustment value, said axial length being adjusted from said preadjustment value to an operational value by said positioning device (10) being operatively combined with said construction (32) and said manipulating unit being subsequently actuated, said adapter elements (54,56) being secured in a relative position corresponding to said preadjustment value by a securing force, said securing force being larger than said prestress force, said manipulating unit (38) having a substantially axially movable engagement member (50) acting onto said adapter unit (52), said engagement member (50) having an axial stroke limited by first stroke abutment means (46), said first stroke abutment means (46) maintaining said engagement member (50) in a first axial position, when assembling said construction unit (32) and said positioning device (10), said axial stroke (48) being further limited by second stroke abutment means (48), said second stroke abutment means (48) preventing excessive axial movement of said engagement member (50) beyond a second axial position.

30. A length variable and lockable positioning device having a longitudinal axis and two ends and having adjacent one of its ends a locking control system with an adapter unit (52), said adapter unit (52) being oriented and movable along said longitudinal axis and having one end in operative connection with a locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56), a first adapter element (54) operatively nearer to said locking means (24) and a second adapter element (56) operatively nearer to said manipulating unit (38), said adapter elements (54,56) being axially adjustable with respect to each other without relative rotation during relative axial adjustment and being fixable with respect to each other in a plurality of relative axial adjustment positions L with a fixing force sufficient to transmit axial control movement from said manipulating unit (38) to said first adapter element (54), said adapter unit (52) being prestressable towards a rest position with respect to said positioning device by a prestress force and being axially movable by said manipulating unit (38) towards a control position against said prestress force, said adapter elements (54,56) being adjusted, before said positioning device (10) is assembled with said construction (32), in a relative position in which said axial length of said control unit (52) is at a preadjustment value, said axial length being adjusted from said preadjustment value to an operational value by said positioning device (10) being operatively combined with said construction (32), said adapter elements (54,56) being secured in a relative position corresponding to said readjustment value by a securing force (78), said securing force being smaller than said prestress force, said fixing force being established by relative rotation of said adapter elements (54,56) about an axis of relative rotation in a first sense of relative rotation, said relative rotation being substantially free of axial relative movement of said adapter elements (54,56) and being smaller than 360°.

31. A length variable and lockable positioning device having a longitudinal axis and two ends and having adjacent one of its ends a locking control system with an adapter unit (52), said adapter unit (52) being oriented and movable along said longitudinal axis and having one end in operative connection with a locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56), a first adapter element (54) operatively nearer to said locking means (24) and a second adapter element (56) operatively nearer to said manipulating unit (38), said adapter elements (54,56) being axially adjustable with respect to each other without relative rotation during relative axial adjustment and being fixable with respect to each other in a plurality of relative axial adjustment positions L with a fixing force sufficient to transmit axial control movement from said manipulating unit (38) to said first adapter element (54), said adapter unit (52) being prestressable towards a rest position with respect to said positioning device by a prestress force and being axially movable by said manipulating unit (38) towards a control position against said prestress force, said adapter elements (54,56) being adjusted, before said positioning device (10) is assembled with said construction (32), in a relative position in which said axial length of said control unit (52) is at a preadjustment value, said axial length being adjusted from said preadjustment value to an operational value by said positioning device (10) being operatively combined with said construction (32), said adapter elements (54,56) being secured in a relative position corresponding to said preadjustment value by a securing force, said securing force being smaller than said prestress force of said adapter elements (54,56), said fixing force being obtained by activation of an adhesive (235) in response to axial relative adjustment of said adapter elements (54,56) towards an operational relative position.

32. A length variable and lockable positioning device having a longitudinal axis and two ends and having adjacent one of its ends a locking control system with an adapter unit (52), said adapter unit (52) being oriented and movable along said longitudinal axis and having one end in operative connection with a locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56), a first adapter element (54) operatively nearer to said locking means (24) and a second adapter element (56) operatively nearer to said manipulating unit (38), said adapter elements (54,56) being axially adjustable with respect to each other without relative rotation during relative axial adjustment and being fixable with respect to each other in a plurality of relative axial adjustment positions L with a fixing force sufficient to transmit axial control movement from said manipulating unit (38) to said first adapter element (54), said adapter unit (52) being prestressable towards a rest position with respect to said positioning device by a prestress force and being axially movable by said manipulating unit (38) towards a control position against said prestress force, said adapter elements (54,56) being adjusted, before said positioning device (10) is assembled with said construction (32), in a relative position in which said axial length of said control unit (52) is at a preadjustment value, said axial length being adjusted from said preadjustment value to an operational value by said positioning device (10) being operatively combined with said construction (32), said adapter elements (54,56) being secured in a relative position corresponding to said preadjustment value by a securing force, said securing force being larger than said prestress force, releasable holding means (351) being provided for axially holding said first adapter element (354) in a rest position with respect to said positioning device (310) during operatively combining said positioning device (310) with said construction (32), said securing force providing said fixing force after adjusting said operational value and releasing said holding means (351).

33. A length variable and lockable positioning device having a longitudinal axis and two ends and having adjacent one of its ends a locking control system with an adapter unit (52), said adapter unit (52) being oriented and movable along said longitudinal axis and having one end in operative connection with locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56) a first adapter element (54) operatively nearer to said locking means (24) and a second adapter element (56) operatively near to said manipulating unit (38), said adapter elements (54,56) being axially adjustable with respect to each other without relative rotation during relative axial adjustment and being fixable with respect to each other in a plurality of relative axial adjustment positions L with a fixing force sufficient to transmit axial control movement from said manipulating unit (38) to said first adapter element (54), said locking adapter unit (52) being prestressable towards a rest position by a prestress force and being axially movable by said manipulating unit (38) towards a control position against said prestress force, said adapter elements (54,56) being relatively adjusted, before said positioning device (10) is assembled with said construction (32), such that said axial length of said adapter unit (52) is at a preadjustment value, said axial length being adjusted from said preadjustment value to an operational value by said position device (10) being operatively combined with said construction (32) and said manipulating unit being subsequently actuated, said adapter elements (54,56) being secured in a relative position corresponding to said preadjustment value by a frictional securing force, said frictional securing force being larger than said prestress force, said manipulating unit (38) having a substantially axially movable engagement member (50) acting onto said adapter unit (52), said engagement member (50) having an axial stroke limited by first stroke abutment means (46), said first stroke abutment means (46) maintaining said engagement member (50) in a first axial position, when assembling said construction unit (32) and said positioning device (10), said axial stroke (48) being further limited by second stroke abutment means (48), said second stroke abutment means (48) preventing excessive axial movement of said engagement member (50) beyond a second axial position.

34. A length variable and lockable positioning device having a longitudinal axis and two ends and having adjacent one of its ends a locking control system with an adapter unit (52), said adapter unit (52) being oriented and movable along said longitudinal axis and having one end in operative connection with a locking means (24) of said positioning device (10) and a second end adapted for operative engagement with an external manipulating unit (38) of a construction (32) adapted to be operatively combined with said positioning device (10), said adapter unit (52) having an adjustable axial length and comprising at least two telescopically interengaging adapter elements (54,56), a first adapter element (54) operatively nearer to said locking means (24) and a second adapter element (56) operatively nearer to said manipulating unit (38), said adapter elements (54,56) being axially adjustable with respect to each other without relative rotation during relative axial adjustment and being fixable with respect to each other in a plurality of relative axial adjustment positions L with a fixing force sufficient to transmit axial control movement from said manipulating unit (38) to said first adapter element (54), said adapter unit (52) being prestressable towards a rest position with respect to said positioning device by a prestress force and being axially movable by said manipulating unit (38) towards a control position against said prestress force, said adapter elements (54,56) being adjusted before said positioning device (10) is assembled with said construction (32) in a relative position in which said axial length of said control unit (52) is at a preadjustment value, said axial length being adjusted from said preadjustment value to an operational value by said positioning device (10) being operatively combined with said construction (32), said adapter elements (54,56) being secured in a relative position corresponding to said preadjustment value by an axial securing force (78).

35. A positioning device as set forth in claim 4, said securing force being provided by a securing spring (78) urging said adapter elements (54,56) towards a relative preadjustment position corresponding to said preadjustment value.

36. A positioning device as set forth in claim 4, said securing force being provided by relative frictional engagement of said adapter elements (254, 256).

37. A positioning device as set forth in claim said securing force being provided by a spacer body (233) destroyable in response to axial relative adjustment of said adapter elements (254, 256) towards said operational value of length.

* * * * *

UNITED STATES PATENT AND TRADEMARK OFFICE

CERTIFICATE OF CORRECTION

PATENT NO. : 5,012,996

DATED : May 7, 1991

INVENTOR(S) : Poertzgen et al.

It is certified that error appears in the above-identified patent and that said Letters Patent is hereby corrected as shown below:

Title page, 15th line of Abstract, "level" should read --lever--;
Col. 1, line 53, "element" should read --adapter element--;
Col. 1, line 56, "adapterelement" should read --adapter element--;
Col. 4, line 34, "control" should read --adapter--;
Col. 5, line 17, "adapter pin" should read --control pin--;
Col. 5, line 51, "adapter pin" should read --control pin--;
Col. 5, line 61, "adapter pin" should read --control pin--;
Col. 6, line 20, "adapter" should read --control--;
Col. 6, line 38, "adapter pin" should read --control pin--;
Col. 6, line 67, "face" should read --faces--;
Col. 7, line 7, "adapter" (2nd occurrence) should read --control--;
Col. 7, line 9, "adapter" should read --control--;
Col. 7, line 28, "control element" should read --adapter element--;
Col. 7, line 30, "adapter pin" should read --control pin--;
Col. 7, line 39, "adapter" should read --control--;
Col. 7, line 42, "adapter" should read --control--;
Col. 7, line 54, "adapter" should read --control--;
Col. 7, line 66, "adapter" should read --control--;
Col. 8, line 7, "FIG. 4" should read --In FIG. 4--;
Col. 8, line 15, "adapter pin" should read --control pin--;
Col. 8, line 23 (both instances), "adapter pin" should read --control pin--;
Col. 8, line 28, "adapter" should read --control--;
Col. 8, line 34, "adapter pin" should read --control pin--;
Col. 8, line 45, "adapter pin" should read --control pin--;

UNITED STATES PATENT AND TRADEMARK OFFICE

CERTIFICATE OF CORRECTION

PATENT NO. : 5,012,996

DATED : May 7, 1991

INVENTOR(S) : Poertzgen et al.

It is certified that error appears in the above-identified patent and that said Letters Patent is hereby corrected as shown below:

Col. 8, line 48, "adapter" should read --control--;
Col. 8, line 61, delete the comma after "this";
Col. 11, line 10, "(10)" should read --gas spring (10)--;
Col. 11, line 15, "adapter pin" should read --control pin--;
Col. 11, line 64, "positioning" should read --positions--;
Col. 13, line 43, "(54, 56)" should read --(254,256)--;
Col. 16, line 22, "claim" should read --claim 4--.

Signed and Sealed this

Twenty-seventh Day of October, 1992

*Attest:*

*Attesting Officer*

DOUGLAS B. COMER

*Acting Commissioner of Patents and Trademarks*